US005746337A

United States Patent [19]

Haist

[11] Patent Number: 5,746,337

[45] Date of Patent: May 5, 1998

[54] CONTAINER, IN PARTICULAR A BOTTLE FOR LIQUIDS WHICH MAY BE UNDER PRESSURE

[75] Inventor: Henri Haist, Neunkirch, Switzerland

[73] Assignee: HVB Innova AG, Neunkirch,, Switzerland

[21] Appl. No.: 556,876

[22] Filed: Nov. 2, 1995

[30] Foreign Application Priority Data

Nov. 7, 1994 [DE] Germany ..... 44 39 464.0

[51] Int. Cl.[6] ..... B65D 1/02

[52] U.S. Cl. ..... 215/44; 215/307; 215/902

[58] Field of Search ..... 215/44, 45, 307, 215/902; 220/366.1

[56] References Cited

U.S. PATENT DOCUMENTS

| | | | |
|---|---|---|---|
| 781,702 | 2/1905 | Waugh | 215/45 X |
| 2,353,520 | 7/1944 | Stanley | 215/45 X |
| 2,423,295 | 7/1947 | Crabbe et al. . | |
| 3,042,247 | 7/1962 | Bonnet | 220/366.1 |
| 3,181,720 | 5/1965 | Cassie et al. . | |
| 4,231,489 | 11/1980 | Malone | 220/304 |
| 5,024,345 | 6/1991 | Deweerdt | 220/366.1 |

FOREIGN PATENT DOCUMENTS 3642998 5/1988 Germany .

*Primary Examiner*—Stephen Cronin

*Attorney, Agent, or Firm*—Cushman Darby & Cushman Intellectual Property Group of Pillsbury Madison & Sutro LLP

[57] ABSTRACT

A container or bottle with a cap for resealing where the seal is produced between the upper lip and, if needed, the lateral lip of the container while the interior closing surface of the cap is provided with a sealing mass which can be deformed within limits and which, after opening and resealing of the container with the cap can be deformed to allow venting from the interior of the container by the provision of a depression formed on the lip of the container and into which the sealing mass will extend to effect sealing but which, after opening, and repositioning of the cap relative to the container, will affect only partial sealing of the container.

6 Claims, 5 Drawing Sheets

CONTAINER, IN PARTICULAR A BOTTLE FOR LIQUIDS WHICH MAY BE UNDER PRESSURE

FIELD OF THE INVENTION

The invention relates to a container, in particular a bottle for liquids which may be under pressure, with a cap suited for resealing, such as a twist cap or the like, wherein a seal results between the upper and if necessary also the lateral lip of the container on the one hand and the inner end surface of the cap on the other hand by means of a sealing mass which can be deformed within limits.

BACKGROUND OF THE INVENTION

Storing fluids under pressure is a known practice. This is the case, for example, for numerous beverages to which carbon dioxide ($CO_2$) is added. In order to prevent a dangerous overpressure, measures have already been suggested which allow a (partial) venting of the dammed-up gas when certain values are exceeded. Measures which were previously developed by the inventor himself (see German Letters Patent DE-PS 36 42 998), have proven particularly worthwhile.

In particular, a container is also known, which has a resealable twist fastener with a seal constituted by a deformable sealing mass according to U.S. Pat. No. 3,181,780. The container has an upper lip with at least one depression running (directed) from the inside toward the outside. The depression has the same significance as an expansion chamber. From the start, the resulting lower density of the sealing mass in the depression makes a gas exchange possible when there are great pressure differences.

All known measures, though, are closely connected with the initial closing of the container or bottle, i.e. they are effective in the desired manner only as long as the conditions dependent upon filling continue to exist at the cap. If on the other hand a bottle is opened and is closed again after being partially emptied, the venting possibilities created with the first closing are reduced or even are eliminated. Resealing no longer occurs under the same (controlled) conditions as during filling, but is then subject to the individual manipulation of the respective user. These can be children or adults, men or women, who on the one hand have different body strengths and on the other hand act more or less consciously or purposefully. In particular men, who as a rule reseal bottles with greater force than is required for the first opening, seem to be critical users.

As a result, an inadmissibly high internal pressure can build up in the bottle until it shatters, with the result of dangerous injuries. This danger occurs particularly in partially emptied $CO_2$-containing beverage bottles with increasing temperature, but also with originally (almost) pressureless beverage bottles with contents which tend to ferment, such as fruit juices and the like, and in fact are more dangerous the more a fermentation is encouraged by high germ counts, temperatures and the like, and the longer conditions like this continue to exist.

OBJECT AND SUMMARY OF THE INVENTION

This is were the invention takes over. In the broadest sense, it is the object of the invention to further develop a container and in particular a bottle of the type mentioned at the beginning in such a way that a reliable venting possibility exists after resealing, even if resealing takes place with a larger expenditure of force and higher pressures act between cap and lip than before the initial opening.

This object is attained according to the invention by mean of the features of the characterizing part of claim 1. Suitable improvements are indicated in the dependent claims.

The basis of the invention is the recognition that each subsequent closing of a container practically always brings with it a position change of the cap with regard to the lip. In the case of a twist cap, the deviation from the state when filling (=first closing) is the greater, the greater or also the smaller the subsequent screw-down value is. The invention takes advantage of this phenomenon in a directed manner by structuring the lip, so to speak, and allowing the sealing mass to fully function only in its initial position. If the position of the cap changes with regard to the lip, the structure of the lip and the sealing mass shaped by it prevent another congruent seal. Instead, there is only an incomplete approach of the sealing mass to the lip in the region of the depression. The sealing losses that occur there can compensate for sealing increases in a particularly forceful resealing or can also result in that after resealing the original venting values are no longer achieved, that is will stay below them in the future. In any event, this means an increase in safety.

As is apparent, with the feature of a depression, the invention abandons, so to speak, the otherwise standard practice of an uninterrupted, continuous sealing plane in connection with an even seal, and in the section of the depression, shifts the seal from the main plane into deeper-lying planes. At the same time, the invention makes use of the knowledge that after a longer storage under compression, sealing masses being used assume an approximate end shape, in which there is only limited deformability at any rate. As a result, this allows optimal sealing when filling, wherein additional measures for venting can be taken at critical overpressures of the as yet unopened containers/bottles, just as before.

The original association of cap and lip after the initial closing can practically be looked upon as the ideal position. When resealing, however, this position can only be reached again by the purest coincidence.

Here, deviations from the original position signify a reduced coverage and sealing in the region of the depression. In this way it is possible, after a resealing, to successfully counteract an excessive pressure increase, which can also occur suddenly as a result of evaporation of dissolved gases and the production of fermentation gases.

On the basis of this kind of basic knowledge it can be left up to one skilled in the art to determine in detail the depth and width of the depressions, their number as well as their other shapes, including their range, and this in view of the respective goal pursued. The above-mentioned parameters can also be determined well empirically. The depth generally need only be selected in the range of tenths of a millimeter. It should be matched primarily to the deformability of the sealing mass, i.e. its restoring force after the end of the particular production process (hot/cold filling, if necessary, by means of pasteurization/sterilization). The width and number of the depressions are correlated with the depth.

A simple fluted shape can turn out to be already sufficient and practical. The widened shape of a channel which is open at the top is particularly effective. In principle, a series of cross sectional shapes are considered for the realization of the concept of the invention, for example a crenelated shape, a saw-tooth shape, and the like. A trapezoidal cross section for the depression appears to be particularly advantageous in this connection.

In a useful manner, the depression extends approximately radially to the axis of the lip. The depression advantageously decreases in the direction of the remaining effective sealing surface, that is, it flattens out increasingly in this direction. If, for example, the effective sealing surface remains on the lateral lip, the depression should be flattened out in this direction, if necessary.

The attainment of the object dealt with here can otherwise be further supported and improved if in case of a plurality of depressions, the number or distribution of the depressions on the upper lip is chosen such that the mutual spacing of the depressions is essentially larger or smaller than the position change to be expected more often than not when resealing.

It is also additionally advantageous if, in case of a plurality of depressions, in particular evenly distributed ones, the width of the depressions preferably varies in such a way that viewed in the circumferential direction of the upper lip, each depression of comparatively small width is followed by a depression of essentially larger width and vice versa. For example, alternating widths of 3 and 6 mm can be provided.

It is true for the embodiment according to the invention as a whole that they are simple to realize because, except for the selection or also only for inspecting the sealing mass, they require no change whatsoever to the cap itself nor to the closing tools or automatic closing machines provided for the production process. The containers or bottles require only a slight structuring of their lip. As a result, there is also the possibility of carrying out a gradual (sliding) conversion from conventional containers/bottles to the ones according to the invention.

The attainment according to the invention is hardly subject to limitations. Thus it is independent of the materials for the containers/bottles (usually plastic or glass) as well as of the materials for the caps (usually metal or plastic), it is further independent of the manufacture of the caps (in particular by rolling during filling or by prior shaping) as well as of the use of the container/bottle as a non-returnable or as reusable packaging. As a result, the invention is undoubtedly of far-reaching significance.

Further details and advantages will be described below by means of the drawing of two exemplary embodiments.

DETAILED DESCRIPTION OF THE PREFERRED EMBODIMENTS

Figure 1:
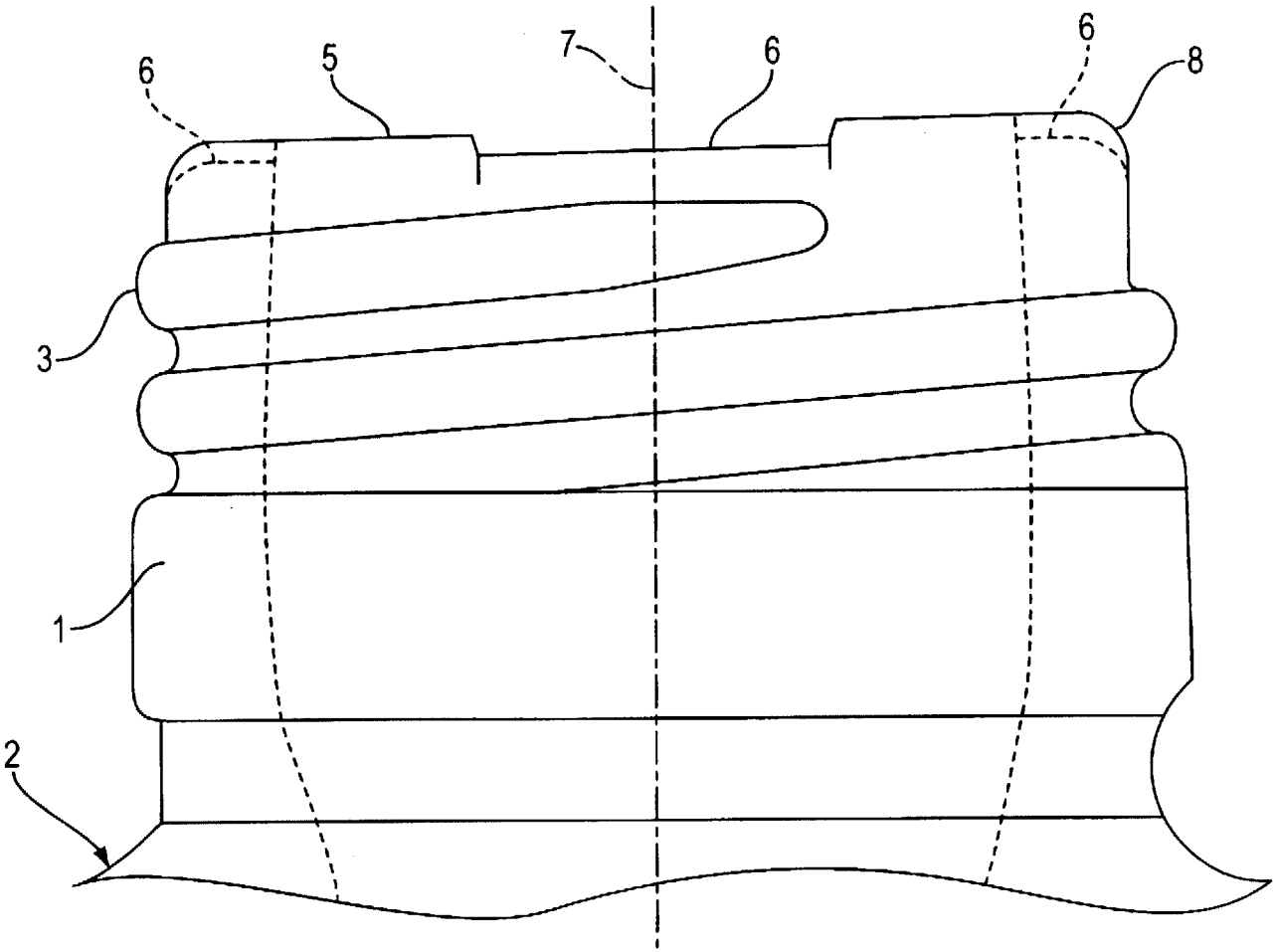
FIG. 1 shows a lateral view of the neck of a glass bottle with threads for a twist cap.
Figure 2:
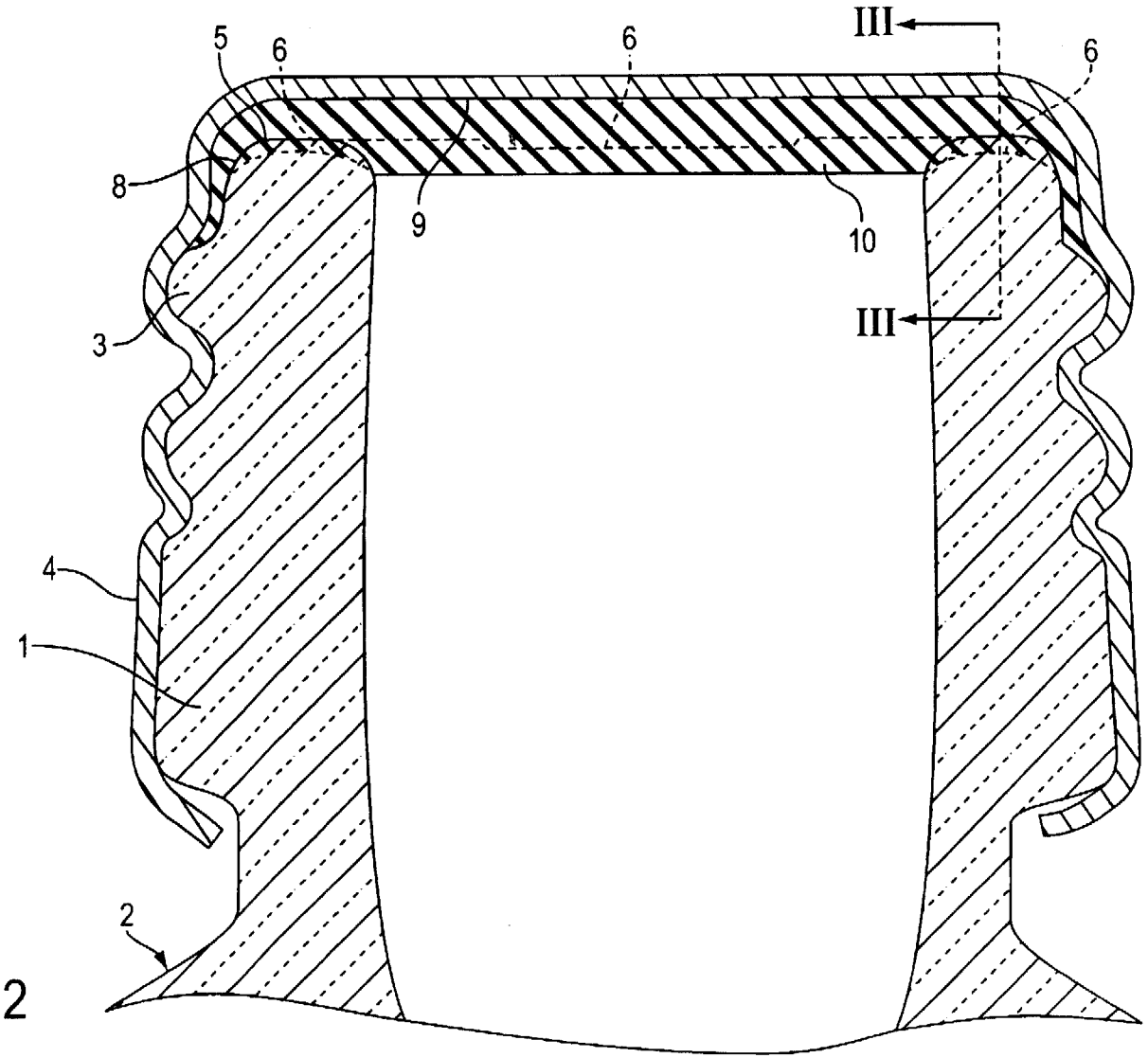
FIG. 2 shows a longitudinal section through the subject of FIG. 1 together with a twist cap.

According to FIG. 1, the neck 1 of a container 2, which here is a glass bottle shown only in part, has a thread 3 for a twist cap 4 (see FIG. 2). The neck 1 has four depressions 6 on the upper lip 5, which extends essentially level. The former are evenly distributed over the circumference of the bottle lip and extend radially in respect to the lip axis 7, wherein they extend with decreasing depth as far as the lateral lip 8, that is, they flatten out. The depressions 6 have an approximately trapezoidal cross section.

The subject of FIG. 1 is inserted into FIG. 2 for a better overall view. As is now apparent from this, a sealing mass 10, which is partially pressed between the above-mentioned closing surface 9 and the upper lip 5 as well as between the lateral lip 8 and the depressions 6, but otherwise protrudes approximately into the open interior of the bottle neck 1 (undeformed), is disposed on the inner closing surface 9 of the cap 4. The state shown guarantees an effective sealing after emptying.

Figure 3A:
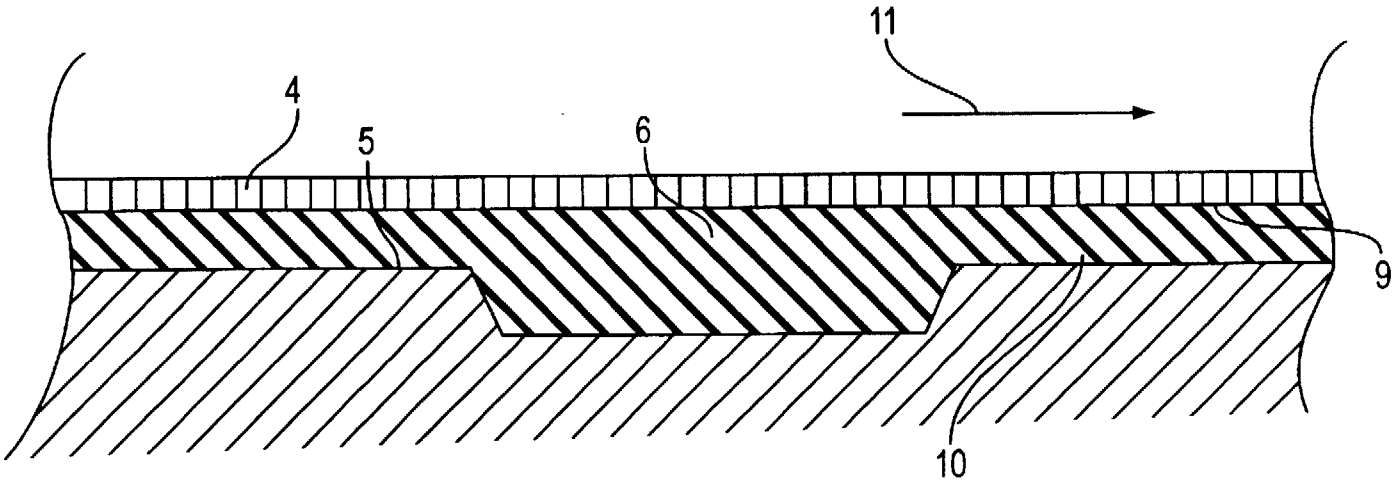
FIG. 3*a* shows an enlargement of the region of the upper lip in a section along line III—III according to FIG. 2, in the state before the first opening of the bottle.

According to FIG. 3*a*, the region of the depression 6 is also completely filled by the sealing mass 10 and prevents an escape of gas as long as the twist cap 4 is not turned in the direction of the arrow 11 to open the bottle.

If the twist cap 4 is later turned in the direction of the arrow 12 to reseal it, a renewed seal results, but no longer in the manner shown in FIG. 3*a*. Instead, in the example shown according to FIG. 3*b* an overtwist can be detected, such as can be assumed in about 30%. of all cases at a band width of 3–5 mm. This overtwist in particular results in that a part of the sealing mass 10, which was previously held in the depression 5, is inserted between the inner closing surface 9 and upper as well as lateral lip 5, 8, and is further compressed. The adjoining part of the sealing mass 10 was already previously more strongly compressed and after longer storage, in particular also after intense heat treatment in the case of a pasteurization or sterilization, has to a large extent lost its ability to swell again (to expand) and hence has roughly assumed a final shape. Thus the region of the depression 6 is now only incompletely filled and sealed by the sealing mass 10.

Figure 3B:
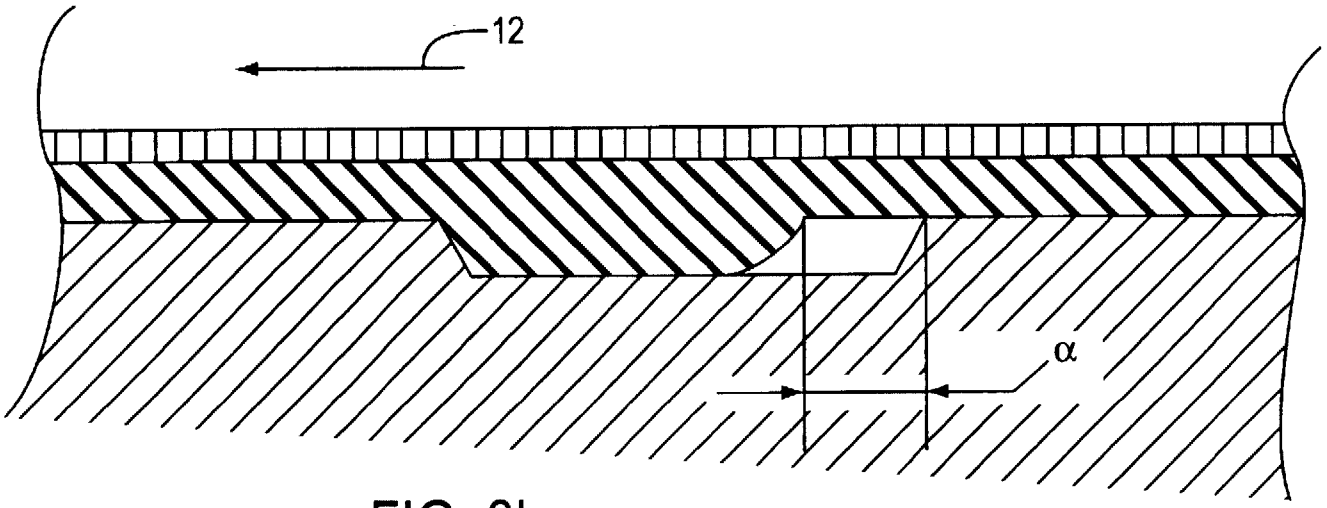
FIG. 3*b* shows the subject of FIG. 3*a* in the state after resealing of the bottle.

The above-mentioned phenomenon is the most significant where the depression 6 is the deepest, that is in the (center) region of the upper lip 5. It decreases with decreasing depth toward the lateral lip 8, where another gradually thinning layer of the sealing mass 10 finally provides a remaining seal on the edge region, which is free of depressions. As a result a seal is assured, on the one hand, up to defined, possibly also reduced pressure values, (depending upon the demands of the respective product down to the simple fluid density) and, on the other hand, timely venting is guaranteed. An uncontrolled pressure increase is ruled out with this simple and reliable embodiment. The movement of the sealing mass 10 resulting from the overtwist when resealing is shown in FIG. 3*b* by means of the segment a. As already mentioned elsewhere, in about 30% of the instances of use it amounts to about 3–5 mm.

The above-described conditions can also be realized solely in the region of the upper lip, namely if the seal is basically intended to be limited to this region.

Figure 4:
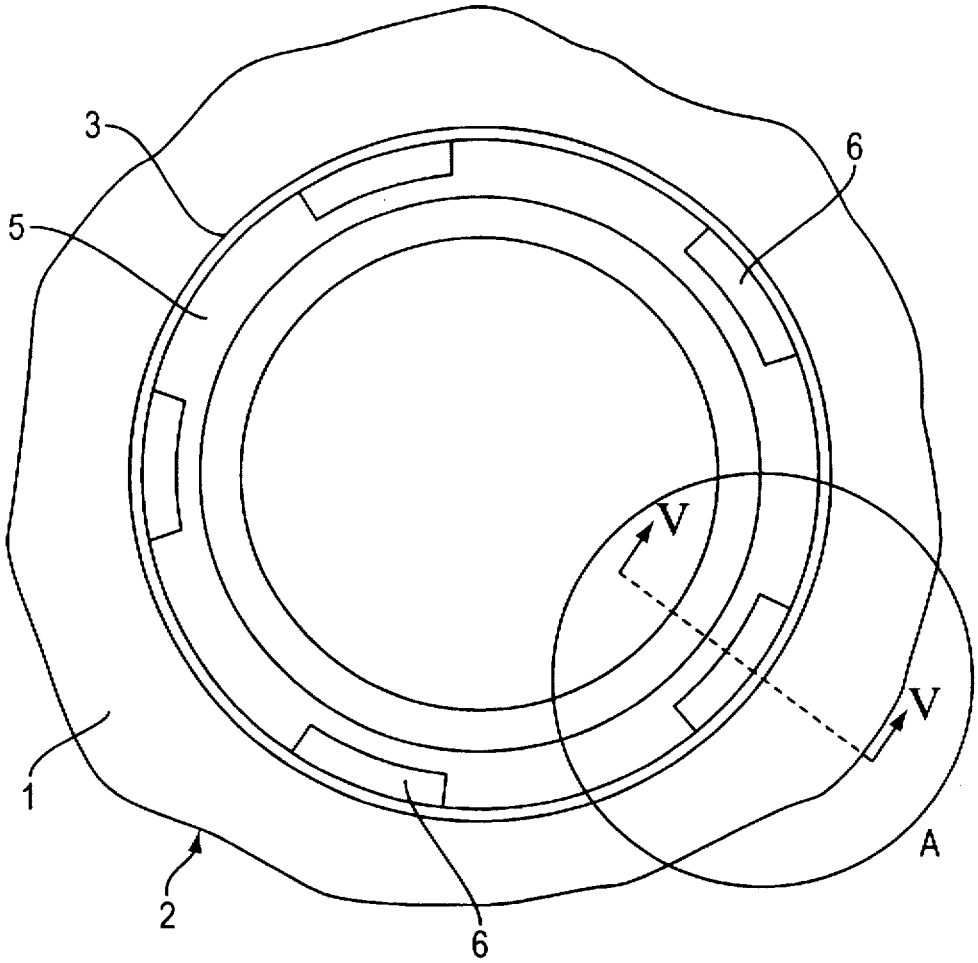
FIG. 4 shows a top view of the neck of a second glass bottle with a lip which is structured differently.
Figure 5:
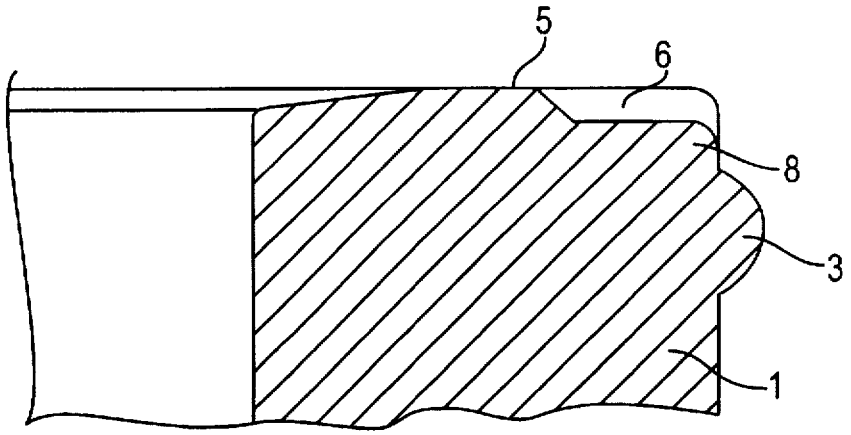
FIG. 5 shows an enlarged version of the detail A from FIG. 4 in a section along the line V—V.
Figure 6:
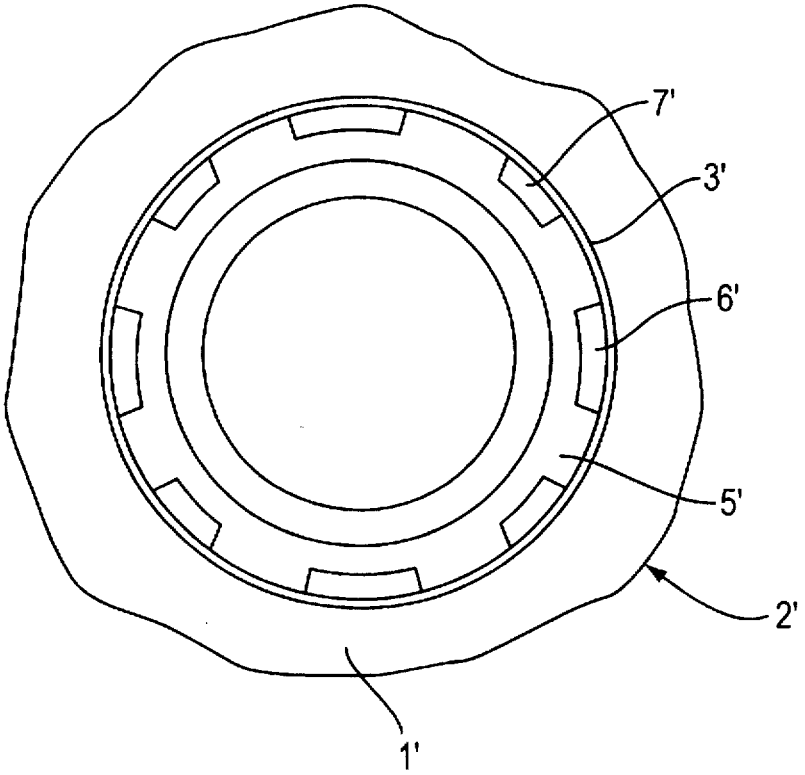
FIG. 6 shows the distribution of a plurality of large and small width depressions in the lip of the bottle.

This applies to the exemplary embodiment shown in FIGS. 4 and 5. In accordance with this, five depressions 6 are disposed evenly distributed around the circumference of the lip. From the lateral lip 8, they extend over a defined distance into the upper lip 5, however without completely interrupting it. Instead, another circumferential, annular remaining sealing surface remains toward the container interior in any case. Its sealing action is admittedly limited in contrast to a sealing surface with the full width of the upper lip 5.

Consequently, the invention solves the problem of an increased danger of bursting after the resealing of liquids which contain or produce gas in a particularly simple and effective way. As a result, for example the recommendation of the Verband der deutschen Fruchtsaftindustrie [Association of the German Fruit Juice Industry] (VDF) to keep the venting values generally below 3 atü can be completely complied with. Previously, this was only possible on initial closure, but not for the case of a resealing.

What is claimed is:

1. A container having an opening with a lip and a cap suited for sealing the opening by means of a sealing mass provided on the cap which can be deformed within limits, said container having an upper lip having at least one depression extending in the direction from the interior of the container to the outside periphery of the lip, said sealing mass having a deformability characteristic such that, upon initial closing of the container, said sealing mass completely fills and seals said depression but once disturbed, no longer fully occupies the depression when the cap position is changed on said lip; a plurality of evenly distributed depressions being provided in the lip of said container, the width of said depressions varying in a way that a depression of relatively small width is followed about the lip with a depresion of larger width in a circumferential direction.

2. The container according to claim 1, characterized in that the depression (6) extends approximately radially with respect to the lip axis (7).

3. The container according to claim 1, characterized in that the depression is flute-shaped.

4. The container according to claim 1, characterized in that the depression (6) has an approximately trapezoidal cross section.

5. The container according to claim 1, characterized in that the depression (6) is increasingly flattened out in the direction toward the remaining effective sealing surface.

6. The container according to claim 1, characterized in that the number of depressions on the upper lip (5) is chosen such that the mutual spacing of the depressions (6) is essentially larger or smaller than the position change which is expected most often when resealing.

* * * * *